US005816727A

United States Patent [19]

Ohba et al.

[11] Patent Number: 5,816,727

[45] Date of Patent: Oct. 6, 1998

[54] COSMETICS CONTAINER

[75] Inventors: Atsushi Ohba; Tomoya Minamino, both of Tokyo, Japan

[73] Assignee: Suzono Kasei Kabushiki Kaisha, Tokyo, Japan

[21] Appl. No.: 690,987

[22] Filed: Aug. 1, 1996

[30] Foreign Application Priority Data

Feb. 2, 1995 [JP] Japan ..... 7-35849
Aug. 28, 1995 [JP] Japan ..... 7-240535

[51] Int. Cl.[6] ..... A45D 40/06
[52] U.S. Cl. ..... 401/68
[58] Field of Search ..... 401/55, 65, 68, 401/49

[56] References Cited

U.S. PATENT DOCUMENTS

| | | | |
|---|---|---|---|
| 885,190 | 4/1908 | Smith | 401/68 |
| 1,637,545 | 8/1927 | Bosworth | 401/55 |
| 2,491,723 | 12/1949 | Gelardin | 401/68 |
| 4,544,296 | 10/1985 | Jarvis et al. | 401/68 X |
| 4,702,634 | 10/1987 | Herold et al. | 401/65 X |
| 4,882,874 | 11/1989 | Paulson et al. | 401/68 X |
| 5,609,430 | 3/1997 | Mazzola et al. | 401/68 X |

FOREIGN PATENT DOCUMENTS

| | | | |
|---|---|---|---|
| 1196278 | 11/1959 | France | 401/68 |
| 3211065 | 11/1982 | Germany | 401/68 |
| 56-37448 | 9/1981 | Japan . | |
| 56-39455 | 9/1981 | Japan . | |
| 57-137198 | 8/1982 | Japan . | |
| 58-10502 | 2/1983 | Japan . | |
| 58-9535 | 2/1983 | Japan . | |
| 2-38669 | 10/1990 | Japan . | |
| 3-50814 | 10/1991 | Japan . | |
| 5-68413 | 9/1993 | Japan . | |
| 4567 | 12/1987 | United Kingdom | 401/68 |

*Primary Examiner*—William E. Stoll
*Attorney, Agent, or Firm*—Frishauf, Holtz, Goodman, Langer & Chick

[57] ABSTRACT

A cosmetic container having a coil-spring shaped holding portion, which is provided at the front end of a push rod, for holding a stick type cosmetic material. The rear end of a stick type cosmetic material is inserted into the center hollow-portion of the coil-spring holding portion. Ribs are optionally provided on the inner surface of the coil-spring holding portion for biting into a stick type cosmetic material to more securely hold the stick type cosmetic material. Even without these ribs, the spring-type holding portion holds a stick type cosmetic material elastically tight by making the inner diameter of the coil-spring smaller, because the coil-spring shaped holding portion holds a stick type cosmetic material elastically. If pressure is applied to a held stick type cosmetic material from the side, the coil-spring shaped holding portion bends and prevents damage to the held stick type cosmetic material. If an axial force is applied to a stick type cosmetic material to extract it from the container, for example if the container is dropped, the spring portion of the coil-spring holding portion will axially stretch to resiliently or elastically hold the stick type cosmetic material to prevent it from being damaged and/or extracted from the container.

24 Claims, 10 Drawing Sheets

COSMETICS CONTAINER

BACKGROUND OF THE INVENTION

This invention relates to a cosmetic container for feeding a stick type cosmetic material such as, for example, lipstick, eye-liner, eye-brow definer, etc. More particularly, this invention relates to a cosmetic container for feeding a stick type cosmetic material utilizing an improved holding portion, which holds the stick type cosmetic material in the container.

Basically, a container for feeding a stick type cosmetic material has a holding portion, which is called a chuck or a cup, to hold the stick type cosmetic material.

FIG. 13 shows a cross-sectional view of the holding portion of a prior art container for feeding a stick type cosmetic material 801. The holding portion 803 comprises a bar member 809 and a cavity 805, which is formed on the top end of the bar member 809. The rear or bottom end of the stick type cosmetic material 801 is inserted into the cavity 805 and is held therein by the elasticity of the side wall 804 of the cavity 805. Vertical slots 807 are so arranged on the side wall 804 of the cavity 805 as to add more elasticity to the side wall 804 and so as to more elastically hold the rear or bottom end of the stick type cosmetic material 801 in the cavity 805.

However, with the structure of the holding portion of the prior art as shown in FIG. 13, the holding portion 804 does not have sufficient flexibility. Therefore, when the stick type cosmetic material is inserted into the holding portion, or when the assembled unit is dropped, the stick type cosmetic material 801 is sometimes broken, or comes out of the holding portion. Such a problem does not often occur, but it cannot be ignored because if the stick type cosmetic material becomes damaged, this will be a fatal defect for the cosmetic container.

SUMMARY OF THE INVENTION

Therefore, the object of this invention is to provide a container for feeding a stick type cosmetic material which will not damage the stick type cosmetic material.

According to a first feature of the present invention, in a container for feeding a stick type cosmetic material wherein the stick type cosmetic material is advanced and retracted, the improvement comprises a coil-spring shaped holding portion engaged with an end portion of the stick type cosmetic material and which holds the stick type cosmetic material in a case of the container such that the stick type cosmetic material is elastically movable relative to the container at least in a longitudinal direction of the container. According to an aspect of the invention, a container for feeding a stick type cosmetic material, comprises a front cylinder having a bore in which the stick type cosmetic material is mounted so as to be advance or retracted relative to said front cylinder; a main cylinder coupled to said front cylinder in an axial direction of said front cylinder so as to be rotatable relative to said front cylinder, for feeding the stick type cosmetic material axially of said front and main cylinders in advancing and retracting directions; and a coil-spring shaped holding portion at a front end of said push rod for engaging an end portion of the stick type cosmetic material and for holding the stick type cosmetic material such that the stick type cosmetic material is elastically movable relative to said push rod and relative to said front and main cylinders at least in the axial direction of said front and main cylinders. The holding portion itself can be integrated with the push rod into one body, or it can be another part, such as a chuck, fixedly attached to the push rod.

According to another aspect of the invention, a container for feeding a stick type cosmetic material, comprises a main body having a push rod housed therein such that said push rod is movable relative to said main body in an axial direction of said push rod and said main body; and a cartridge, rotatably attached to a front end of said main body, which feeds the stick type cosmetic material in said axial direction. The push rod is movable axially inside of said cartridge when said main body and said cartridge are relatively rotated. The cartridge has a chuck which is engageable with said push rod, said chuck having a coil-spring shaped holding portion, said coil-spring shaped holding portion being engaged with an end portion of the stick type cosmetic material for holding the stick type cosmetic material such that the stick type cosmetic material is elastically movable relative to said push rod and relative to said cartridge and main body at least in the axial direction of said cartridge and main body.

In a case where the stick type cosmetic material is injected (while being warmed up to be softened for injection molding) into the opening of the container after assembling of the container, the cosmetic material enters into between the tendrils (coils) of the coil-spring shaped holding portion, and thereafter cools and becomes firm. Therefore, the stick type cosmetic material will be strongly held by the coil-spring shaped holding portion.

DETAILED DESCRIPTION OF THE PREFERRED EMBODIMENT

Figure 1A:
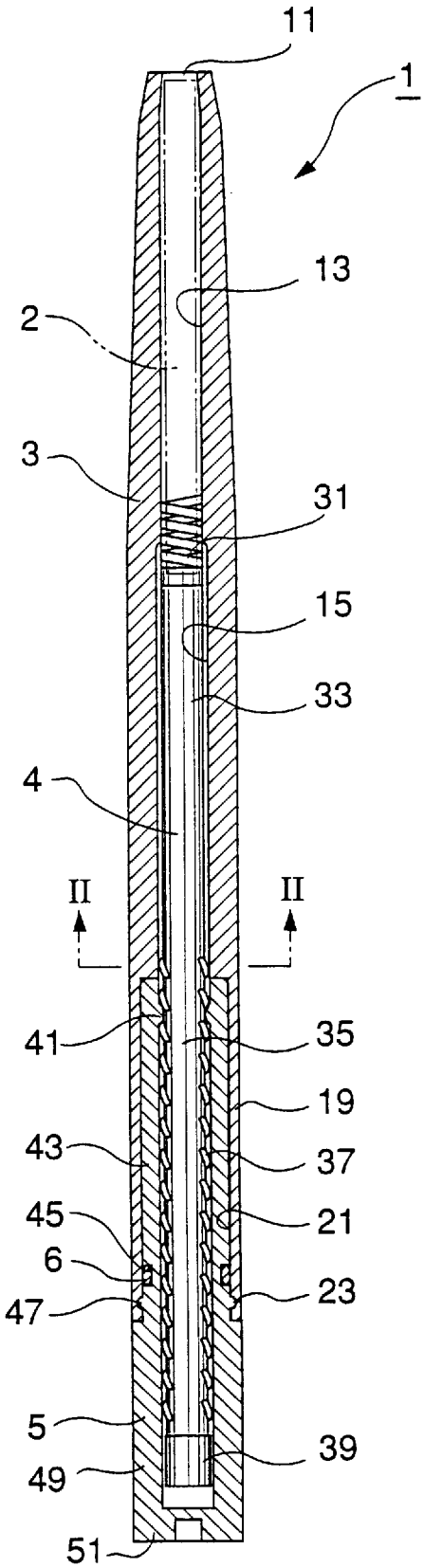
FIG. 1A shows a cross-sectional view of an assembled container for feeding a stick type cosmetic material according to one embodiment of this invention.
Figure 1B:
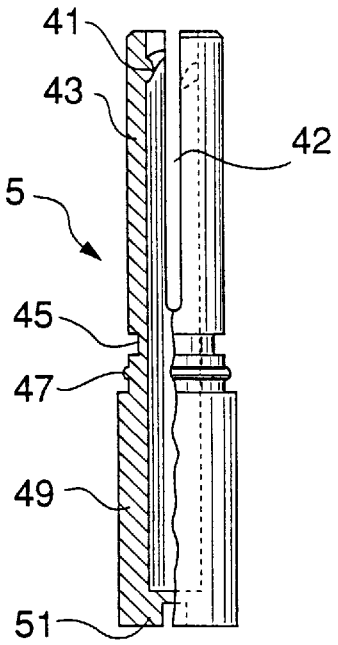
FIG. 1B shows a partial cross-sectional view of the main cylinder of the embodiment shown in FIG. 1A.

FIGS. 1A and 1B show a container for feeding a stick type cosmetic material 2 according to one embodiment of this invention. FIG. 1A shows a cross-sectional view of the whole container which is completely assembled, and FIG. 1B shows a cross-sectional view of the main cylinder.

Figure 2:
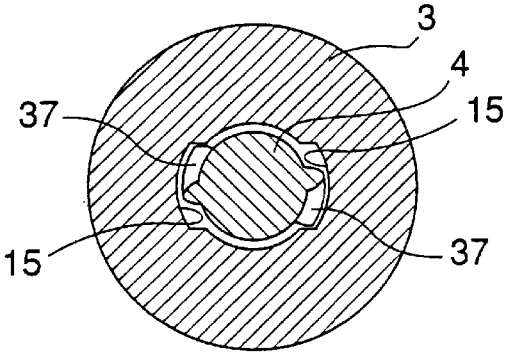
FIG. 2 shows a cross-section taken along line II—II in FIG. 1A.

FIG. 2 shows a cross-section taken along line II—II in FIG. 1A.

Figure 3:
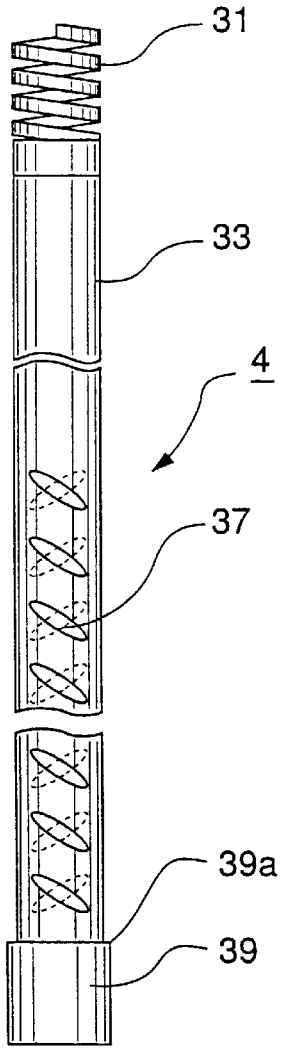
FIG. 3 shows a side view of the push rod of the embodiment of FIG. 1A.

FIG. 3 shows a side view of the push rod 4 of FIG. 1A.

As seen in FIG. 1A, the container 1 for feeding a stick type cosmetic material 2 comprises a front cylinder 3, a push rod 4, and a main cylinder 5. The front cylinder 3 is so connected to the main cylinder 5 that the main cylinder 5 can rotate axially relative to the front cylinder 3. The push rod 4 is housed inside of the front cylinder 3 and is axially slidable in the front cylinder 3 but is not rotatable relative to the front cylinder 3.

The push rod 4 is also spirally engaged with the main cylinder 5 via a spiral threaded engagement 37 (to be described later). Accordingly, when the front cylinder 3 and the main cylinder 5 are rotated relative to each other, the push rod 4 will advance or retract axially in the front cylinder 3.

The front cylinder 3 is a hollow cylinder, which has a bore 13 where the stick type cosmetic material 2 and the push rod 4 are slidably moved. About ¼ of the lower portion of the inner diameter of the front cylinder 3 is wider than the upper portion, so as to be attached to the outer circumference of the upper portion of the main cylinder 5. At least one vertical or axially directed groove 15 is formed at the middle portion of the bore 13 of the front cylinder 3. As best shown in FIGS. 2 and 3, a group of projections 37 are formed on the outer surface of the push rod 4. The projections 37 are engaged with the axial groove 15, so the front cylinder 3 and the push rod 4 can be synchronously engaged with each other but are essentially non-rotatable relative to each other.

A coil-spring shaped holding portion 31 (see FIGS. 1A and 3) is formed on the front end of the push rod 4. A rear or lower end of a stick type cosmetic material 2 is inserted into the center bore of the coil-spring holding portion 31 and is firmly engaged and retained in the push rod 4. By virtue of this arrangement, the stick type cosmetic material 2 is connected to push rod 4 and is moved axially with the push rod 4.

As shown in FIG. 3, the group of projections 37 are provided on approximately the lower half surface of the push rod 4, and these projections 37 are arranged linearly in two rows which extend in the axial direction with an angle of 180° between the rows in the circumferential direction. These projections 37 are also so arranged as to occupy one part of two of imaginary external threads on the outer surface of the push rod 4. These projections 37 are not only used to serve as synchronously engageable "ribs" which are elongated axially or vertically, but they also serve as external screw threads. That is, the projections 37 are engaged with the synchronously engageable vertical or axial grooves 15 (FIG. 2) as synchronously engageable ribs, and they also spirally engage with projections 41 (see FIGS. 1A and 1B) which are formed as an internal thread, of the main cylinder 5. The projections 37 are arranged and inclined so as to serve as the external thread which threadedly engages the internal thread 41.

Each one of the projections 37 has an oval-shape profile, as seen in FIG. 3, and they are also arranged with an angle of 90° from the parting line which is made by injection molding of the push rod 4. Moreover, the projections 37 are wider in width than the width of the slits 42 (described later). Therefore, the spiral engagement of the projections 37 and the internal thread 41 is smoothly accomplished.

The rear end of the push rod 4 is a wider diametered section 39, as seen in FIGS. 1A and 3. The outer diameter of the wider diametered section 39 is almost the same as the diameter at the peak of the projections 37. Because the lower surface of the wider diametered section 39 meets the upper surface of the end flange 51 of the main cylinder 5, the retracting extremity of the push rod 4 is limited. Also, since the upper surface 39*a* of section 39 meets the internal thread 41 at the uppermost position of the push rod 4, the advancing extremity of the push rod 4 relative to the cylinders 3 and 5 is limited. The wider diametered section 39 can be inserted into the main cylinder 5 by opening or spreading the slit 42 (see FIG. 1B) of the main cylinder 5 to expand the opening of the internal thread to accept the wider diametered section 39.

The main cylinder 5 has a hollow-cylindrical shape with a closed bottom 51. The connecting section 43 of the main cylinder 5 is narrower (i.e., has a smaller diameter), and the slits 42 are formed in the connecting section 43 from the upper surface toward the rear end. The slits 42 are formed linearly in two rows in the axial direction with a circumferential angle of 180° therebetween. The internal thread-like projections 41 are formed at the upper inner circumference of the connecting section 43 of the main cylinder 5. These internal thread-like projections 43 are arranged in two rows, and each has about a semicircle length for each thread.

The connecting section 43, which comprises about the upper-half portion of the main cylinder 5 with the narrower diameter, is fit into the wider inner diameter connecting hole or opening 21 of the connecting section 19 of the front cylinder 3, whereby the front cylinder 3 and the main cylinder 5 are connected together. An annular circumferential ridge 47 (see Fig. 1B), which is provided at the bottom of the connecting section 43 of the main cylinder 5, is snappingly engaged with an annular recess 23 provided on the rear or lower end of the connecting section 19 of the front cylinder 3, to serve as a stopper and to positively retain (hold) the front cylinder 3 on the main cylinder 5, with the cylinders 3, 5 relatively rotatable. By an O-ring 6, engaged in groove 45 (FIG. 1B), moderate rotational friction will occur between the front cylinder 3 and the main cylinder 5, and because of this rotational friction, each part of the container will be able to operate smoothly. Of course, the container will also function well without the O-ring 6.

The effect of the axially directed slits 42 of the main cylinder 5 will be described hereinafter. The slits 42 help the internal thread 41 to open outward when the internal thread has a spreading pressure applied thereto. In the container for feeding a stick type cosmetic material as shown in FIG. 1A, the main cylinder 5 has a closed bottom (end flange 51), so it is necessary to insert the push rod 4 into the main cylinder 5 from the tip or top opening of the main cylinder 5. However, the wider diametered section 39 is formed on the rear end of the push rod 4 to limit the stroke end, and therefore, the tip or top opening of the main cylinder 5 cannot accept the push rod 4 because of the inwardly protruded portion of the internal thread 41. But, because of the axial slits 42, when the wider diametered section 39 is pushed into the opening of main cylinder 5, the slits 42 will help enable the internal thread portion 41 to open or spread outward enough to accept the wider diameter section 39, and the wider diametered section 39 can thus pass through the internal thread 41 and be received in the inner bore of the main cylinder 5, as seen in FIG. 1A. Accordingly, if the stick type cosmetic material 2 is to be fed by using a fine pitch screw thread, the pitch of the internal thread 41 must be fine, too. As compared with the prior art internal thread which has to be made by injection molding with a core pin rotationally pulled out after molding, the main cylinder 5 of the container of the present invention has the slits 42, so the core pin of the injection molding apparatus can be just pulled out without rotation, since the slits 42 increase resilience of the upper molded end (detailed explanation will follow). By virtue of the combination of the groups of oval-shaped projections 37 and the internal thread member 41 with the slits 42, an inexpensive container with a fine stroke pitch can be provided easily and economically.

As explained above, the bottom of the main cylinder 5 has an integral end flange 51 to reduce the number of members by one, since a separate closure member is not needed. However, because of this end flange 51, the core pin for injection molding for the main cylinder 5 must be pulled out from the tip or top opening of the main cylinder 5, since it cannot be pulled out from the bottom end 51 in FIG. 1A. However, as seen in the drawings, the inner diameter of the hollow portion of main cylinder 5 under the internal thread 41 is obviously wider than the inner diameter of the portion of the crest of the internal thread 41; therefore, the core pin may damage the internal thread 41 when it is withdrawn after molding. However, by the slits 42 which help the internal thread open or spread outward, the core pin can be pulled out of the main cylinder 5 without damaging the internal thread 41 at all.

The container for feeding a stick type cosmetic material as shown in FIG. 1A is assembled as follows: first the bottom 39 of the push rod 4 is inserted into the main cylinder 5. Then the combination of the push rod 4 and the main cylinder 5 is pushed into the front cylinder 3 from the lower opening of the front cylinder 3. After this assemblage, the connecting section 43 of the main cylinder 5 looks as if it is surrounded by a wider O-ring because the outer surface of the connecting section 43 is surrounded by the connecting section 19 of the front cylinder 3. Because of this engagement of portions 19 and 43, the internal thread 41 will not open or spread outward even though it has the slits 42, and the spiral engagement between the internal thread 41 and the external thread-like group of projections 37 will be positively maintained. According to the embodiment described in FIG. 1A, the container is made a little longer because the vertical ribs 37, formed by the groups of the projections 37 of the push rod 4, and which engage in axial grooves 15 (FIG. 2), have an axial length as long as the length of the feeding length of the stick type cosmetic material 2. However, it is possible to shorten the length of the container by shortening the length of the straight portion 33 of the push rod 4 and the length of the bore 13 of the front cylinder 3. In that case, the stick type cosmetic material 2 will slide inside of the portion of the bore 13, which has the vertical or axial grooves 15, but this is no problem to the operation of the apparatus.

Figure 4A:
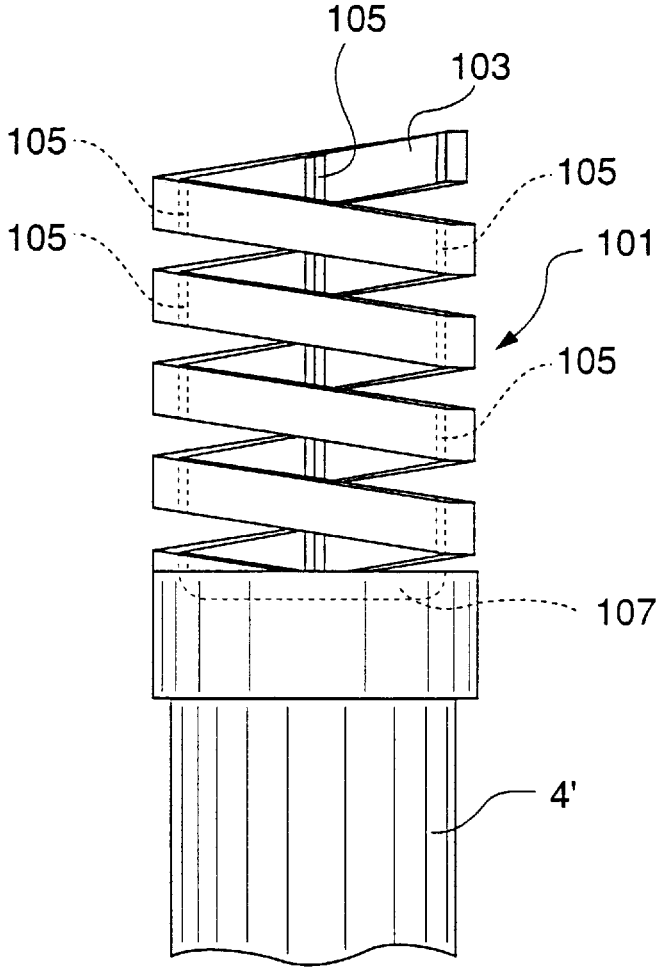
FIG. 4A shows a side view of the coil-spring shaped holding portion of the container for feeding a stick type cosmetic material according to one embodiment of the present invention.
Figure 4B:
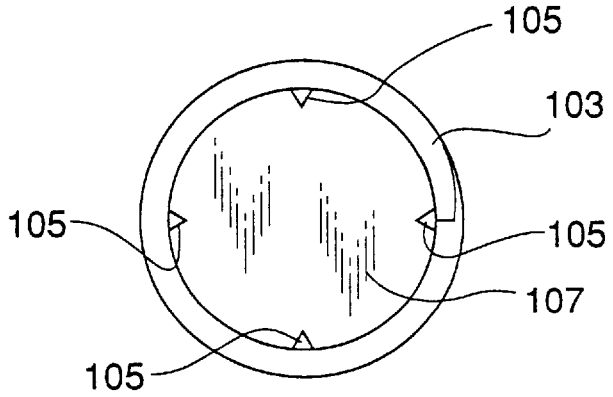
FIG. 4B is a plan view of the holding portion of FIG. 4A.

FIG. 4A shows a side view of one embodiment of a coil spring shaped holding portion having a coil-spring shape. FIG. 4B shows a plan view of the holding portion of FIG. 4A.

The coil-spring shaped holding portion 101 is formed on the front or top end of the push rod 4', to form a single body with the push rod 4'. The coil spring portion 103 is spirally elongated upward from the front end of the push rod 4'. On the inner circumference of the coil spring portion 103, inwardly protruding ribs 105 are formed. Ribs 105 bite into the stick type cosmetic material 2 and hold it more firmly. A recess 107 is optionally formed between the front end of the push rod 4' and the holding portion 101 to make the rear end of the stick type cosmetic material 2 stay more comfortably and firmly. The ribs 105 may be omitted. Even when there are no ribs 105 on the coil portion 103, it is possible to hold the cosmetic material 2 effectively and elastically by making the inner diameter of the coil portion 103 narrower (smaller) than the outer diameter of the stick type cosmetic material 2. Also, if the stick type cosmetic material 2 has an extracting or pulling out force applied thereto, such as if the container is dropped, the coil-spring portion 103 will be axially stretched and will hold and retain the stick type cosmetic material 2. Thus, the coil portion 103 is effective to prevent damage to the stick type cosmetic material even due to dropping.

Figure 5:
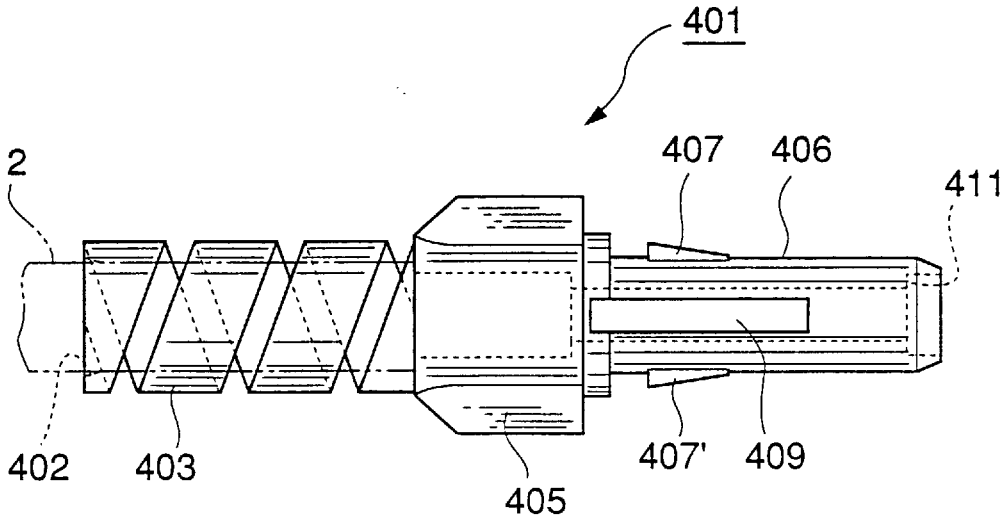
FIG. 5 shows a side view of a chuck utilized for the container for feeding a stick type cosmetic material according to another embodiment of the present invention.
Figure 12:
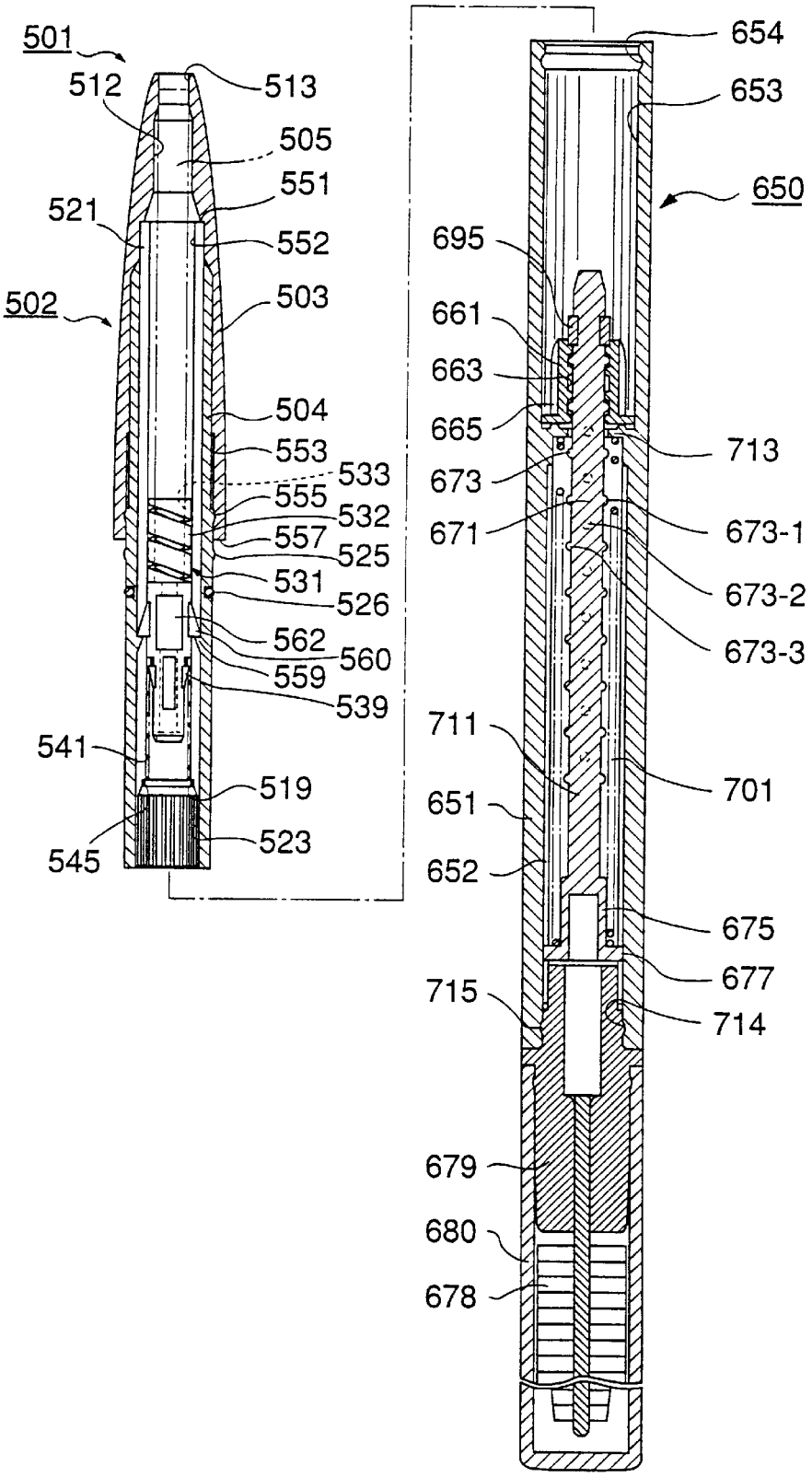
FIG. 12 shows a cross-sectional view of the container for feeding a stick type cosmetic material according to still another embodiment of this invention. The cartridge is shown at the left, and the main body of the container is shown at the right.
Figure 13:
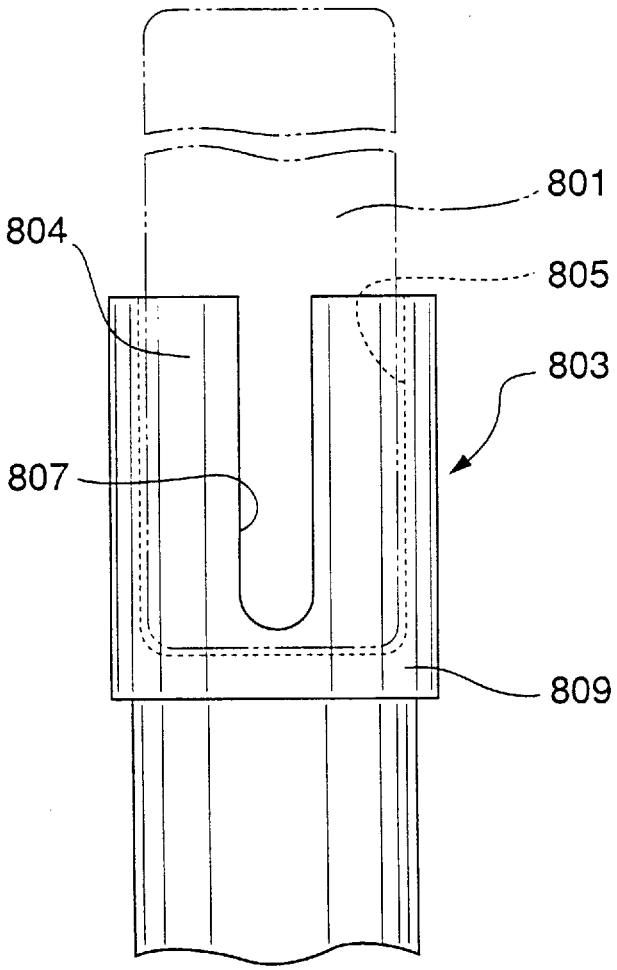
FIG.13 PRIOR ART
FIG. 13 shows a side view of the holding portion of a prior art container for feeding a stick type cosmetic material.

FIG. 5 shows a side view of a chuck utilized for the container for feeding a stick type cosmetic material according to another embodiment of this invention. The cartridge type container for feeding a stick type cosmetic material utilizing the chuck of FIG. 5 is shown in FIG. 12 (to be described later). This container comprises a main body which has an axially slidable push rod, and a detachable cartridge which is attached onto the front end of the main body. The axially slidable stick type cosmetic material 2 is housed inside of the cartridge, and the push rod advances or retracts inside of the cartridge by the relative rotation of the main body and the cartridge. This container is characterized in that it has the chuck of FIG. 5 which has a coil-spring shaped holding portion for holding the stick type cosmetic material 2.

The chuck 401 shown in FIG. 5 has a coil-spring shaped holding portion 403 which holds the stick type cosmetic material 2 by inserting its rear end into the bore of the holding portion 403. The front end of the holding portion (left side in FIG. 5) has a flat surface, and a tapered portion 402 is provided on the inner surface of the holding portion 403. A butt (axially directed projecting portion) 405 is formed protrudely on the outer circumference of the center portion of the chuck 401, and this butt will be engaged with the vertical or axial grooves (see grooves 15 of FIG. 2) which are formed on the bore of the cartridge, which the chuck 401 will be attached to (not shown in the drawing).

The spring retaining section 406 is formed on the outer surface of the rear end (right side in FIG. 5) of the chuck 401, and the pull-spring for automatic returning of the chuck 401 is retained onto the spring retaining section 406. The spring retaining projections 407, 407' (two in number) which are formed on the spring retaining section 406, are provided to hold the pull-spring. The window or opening 409 which is formed between the spring retaining projection 407 and 407', is opened and penetrated through the spring retaining section 406. Because of this window 409, the space between both spring retaining projections 407 and 407' can be contracted by the fingers to enable the pull-spring to pass easily over the projections 407, 407' when the pull spring is attached onto the spring retaining section 406. The push rod (not shown in FIG. 5) is housed inside of the main body and meets the meeting section 411 formed on the rear of the chuck 401. Therefore, the chuck 401 and the stick type cosmetic material 2 can advance or retract together.

Figure 6:
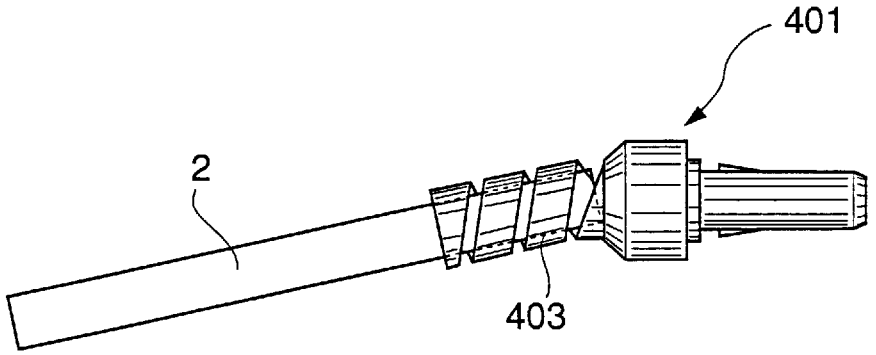
FIG. 6 shows a side view showing a stick type cosmetic material attached onto the chuck of FIG. 5, under the condition that the stick type cosmetic material has pressure applied thereto from the side direction.

FIG. 6 shows a side view of the chuck of FIG. 5 with a stick type cosmetic material 2 which is horizontally pressured.

As shown in FIG. 6, the coil-spring shaped holding portion 403 bends from the bottom thereof to hold firmly the stick type cosmetic material 2. If the coil-spring shaped holding portion 403 did not have such elasticity, the stick type cosmetic material 2 would receive pressure directly and would be broken by the applied pressure. However, such an accident will not occur to the container according to this embodiment of the present invention because of the elasticity of the lower portion of the coil-spring shaped holding portion 403. The number of wires from which the coil of the coil-spring 403 is made, can be more than two. Alternatively, the coil-spring 403 can be a doulbe spiral Also the butts 405, the spring retaining projections 407, 407', and the window 409 can be omitted, depending on the usage of the container.

Figure 7:
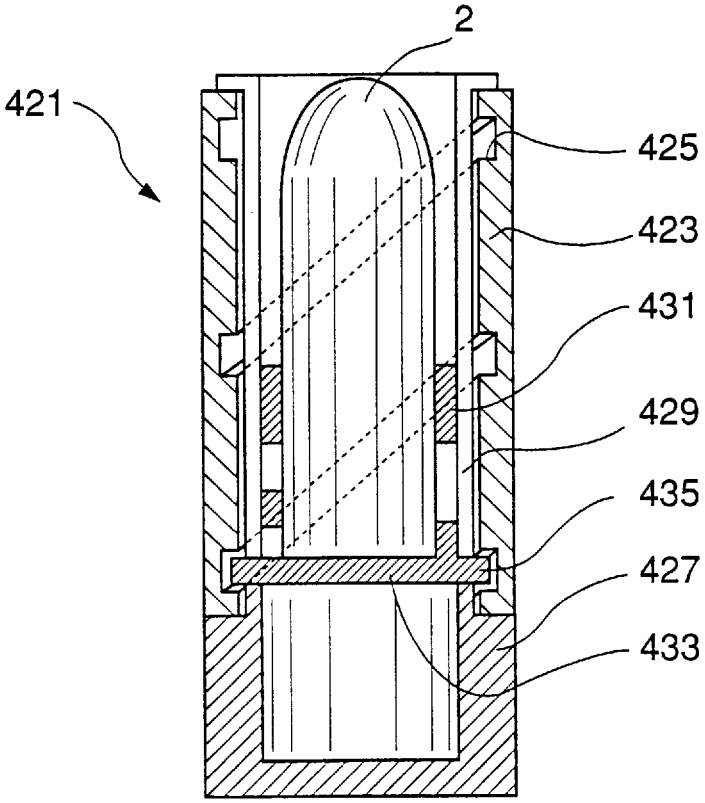
FIG. 7 shows a cross-sectional view of a lipstick container according to another embodiment of the present invention.

FIG. 7 shows a cross-sectional view of a lipstick container according to an embodiment of the present invention.

The lipstick container of FIG. 7 comprises a cylinder 423 having a spiral internal groove 425, a rotational lower cylinder 427, and a cup 433. Among these members, the cylinder 423 and the rotational lower cylinder 427 are almost the same as the ones which are used for a prior art lipstick container. That is, the spirally grooved cylinder 423 is rotationally attached on the upper outer circumference of the rotational lower cylinder 427. A spiral groove 425 is formed on the inner surface of the cylinder 423, and slits 429, which are elongated axially, are formed on the upper portion of the rotational lower cylinder 427.

The butts 435, which are protruded outwardly from the cup 433, are fitted into the slits 429 of the rotational cylinder 427, and the protruded portion of the butts 435 is projected over the slits 429 to spirally engage with the spiral grooves 425 of the cylinder 423. Therefore, when the cylinder 423 and the rotational cylinder 427 are relatively rotated, the cup 433 moves along the spiral groove 425 to make the lipstick advance or retract. This mechanism of feeding a lipstick is almost the same as the former typical prior art type of lipstick container.

The new characteristic feature of the lipstick container in FIG. 7 is the lipstick holding portion 431 of the cup 433.

Figure 8:
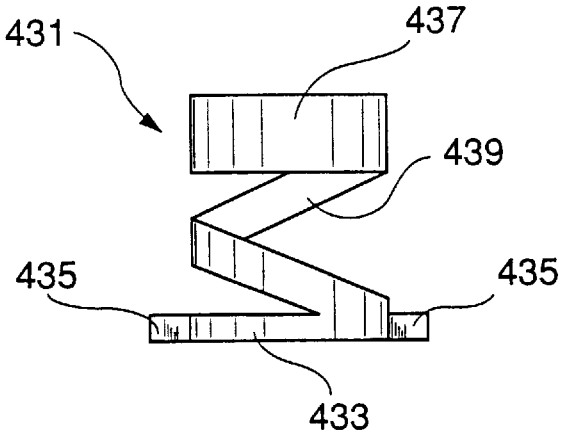
FIG. 8 shows a side view of the holding portion used in the lipstick container of FIG. 7.

FIG. 8 shows a side view of the cup 433 of FIG. 7 which holds the stick type cosmetic material 2. The coil-spring shaped lipstick holding portion 431 is formed on the cup 433. The lipstick holding portion 431 comprises a spiral spring portion 439, and an upper ring 437, which is provided on the front or upper end of the spring 439. The ring 437 holds the lipstick tightly to keep it from dropping off, and the spring 439 gives the holding portion flexibility and resilience. With such a structure of the lipstick holding portion, the lipstick is held firmly and elastically. Also the ring 437 can be formed at a lower area to receive the cosmetic material, contrary to FIG. 8.

Figure 9:
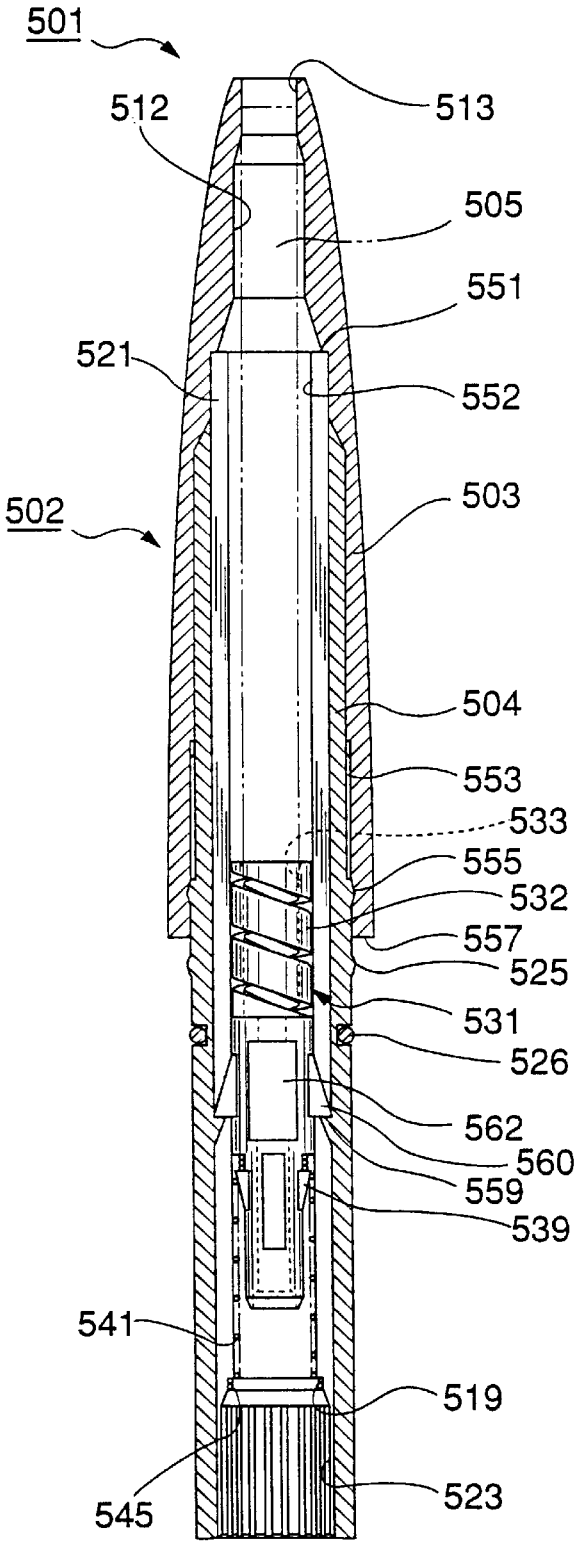
FIG. 9 shows a cross-sectional view of the structure of a cartridge for a container for feeding a stick type cosmetic material according to another embodiment of the present invention.
Figures 10A, 10B:
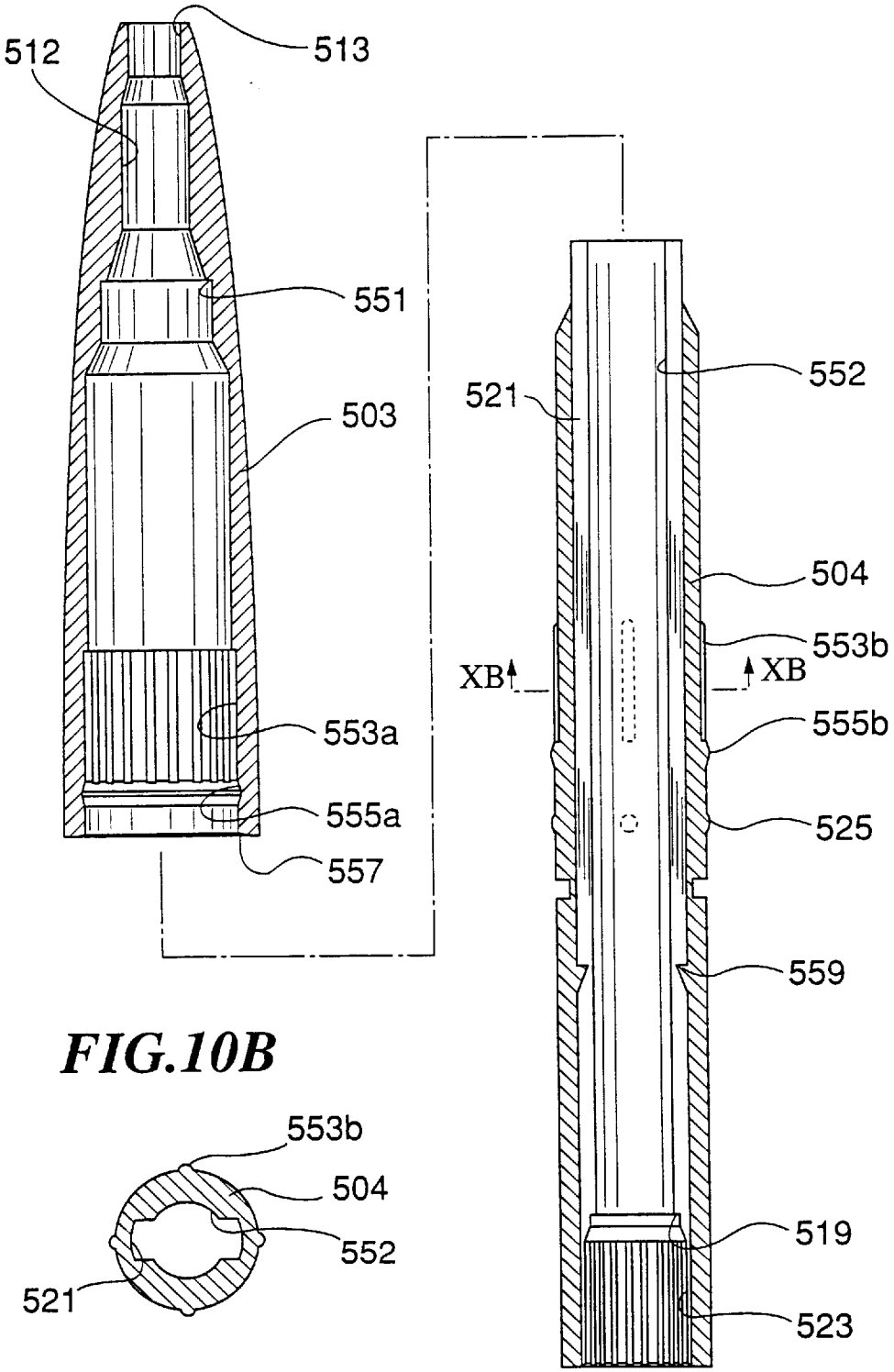
FIG. 10A shows a cross-sectional side view of the disassembled cartridge cylinder of the container of FIG. 9.
Fig. 10B shows a sectional view taken along line XB—XB in FIG. 10A.

FIG. 9 shows a cross-sectional view of the construction of a cartridge of a container for feeding a stick type cosmetic material according to another embodiment of the present invention, and FIG. 10A shows a cross-sectional side view of the disassembled cartridge cylinder of the container of FIG. 9. Fig. 10B shows a sectional view taken along line XB—XB in FIG. 10A.

Referring to FIG. 9, inside of the cartridge cylinder 502, a chuck 531 which holds the end of a stick type cosmetic material 505, is so housed as to be slidable axially. The chuck 531 is urged in a backward (retracted) direction by a pull spring 541.

The first characteristic feature of the cartridge of this embodiment of FIG. 9 is that the cartridge cylinder 502 has a double-cylindrical form, which comprises (see also FIG. 10A) an outer cylinder 503 and an inner cylinder 504, of which about the first half is inserted into the outer cylinder 503. The inner diameter of the tip opening 513 is the sum of the outer diameter of the stick type cosmetic material 505 (e.g., about 2 mm) plus a clearance for the sliding space (e.g., a total inner diameter of about 2.2 mm). This tip opening 513 supports the front end of the stick type cosmetic material 505 diametrically while also permitting the cosmetic material 505 to be axially slidable.

The inner diameter of the outer cylinder 503 gets wider from the tip opening 513 to the back or bottom end thereof. For example, the inner diameter of the outer cylinder 503 at the level 551 is about 4.6 mm. And from the level 551 to the attachment section 557, which is the rear end of the outer cylinder 503, is the double cylindrical portion that comprises the outer cylinder 503 and the inner cylinder 504 where it meets and joins the inner circumference of the outer cylinder 503. As shown in FIG. 10A, the rolet or serrated or keyed portion 553 is a combination of vertical ribs 553*b* formed on the outer circumference of the inner cylinder 504 and vertical grooves 553*b* formed on the inner circumference of the outer cylinder 503, and prevents rotational aberration which would otherwise occur between the outer cylinder 503 and the inner cylinder 504. The engagement ridge and recess 555 is a combination of an annular recess 555*a* and an annular ridge 555*b*, and prevents axial aberration which occurs between the outer cylinder 503 and the inner cylinder 504. By the rolet 553 and the engagement ridge and recess 555, both outer cylinder 503 and inner cylinder 504 can be a cartridge cylinder 502, which looks like one body. From the viewpoint of the outer appearance, both cylinders look like one-body, because the joint of both cylinders is at the corner of the attachment section 557, though there is no problem if they do not look like one-body.

The second characteristic feature of the cartridge of the container for feeding a stick type cosmetic material shown in FIG. 9 is the inner projections 559 which are formed on the inner surface of the bore (rear end portion of the vertical groove 521) and which function as a chuck-stopper. The front end of the inner projections 559 are perpendicular to the inner circumference of the bore, and they form a slope to the rear or bottom end (in this embodiment, the base or each projection 559 is about 1.5 mm, and the height is about 0.45 mm). Because of this shape, it is easy for the butt 560 of the chuck (described later) to be inserted, but it is hard for the chuck to come off.

The inner cylinder 504 is made by plastic injection molding, and the chuck stopper is made by a couple of core pins of the mold, which are inserted from the front end and rear end. That is, when the inner cylinder is molded, a front-side core pin, which is elongated from the front portion of the bore 552 to the upper surface of the inner projections 559, and a rear-end core pin, which is elongated from the engageable grooves 523 to the lower surface of the inner projection 559, are inserted into the mold. The upper surface of the inner projections 559 are formed by the lower surface of the front-side core pin, and the lower surface of the projections 559 are formed by the upper surface of the rear end core pin.

It is possible to utilize this kind of molding technique because the front portion of the bore of the inner cylinder 504 is elongated straightly (diameter about 3.1 mm, and the diameter between the bottom of the vertical grooves is about 4.6 mm). The outer diameter of the chuck 531 is about 3.0 mm, therefore a sliding space (clearance) of about 0.1 mm is added to the diameter of the bore. Also, the outer diameter of the chuck is added to the outer diameter of the stick type cosmetic material, which is about 2 mm, plus the thickness of the chuck 531 itself. On the other hand, the front portion of the bore of the outer cylinder 503 is about 2.2 mm; that is, the outer diameter of the stick type cosmetic material is about 2.0 mm+sliding (clearance) space of about 0.1 mm×both side–about 2.2 mm. After all, the diameter of the bore of the inner cylinder 504 (about 3.1 mm) has to be wider, by about twofold of the thickness of the chuck 513, than the front portion of the diameter 513 of the outer cylinder 503 (about 2.2 mm). Accordingly, if the cartridge cylinder 502 is attempted to be made in one-body with the inner projections 559 by injection molding, the molding core pin which is between the front portion of the bore 513 and the inner projection 559 will be under-cut, and the cartridge cylinder cannot be molded as one single body. Because of such reason, the cartridge cylinder 502 is divided into the outer cylinder 503 and the inner cylinder 504, and the bore 513 is formed on the outer cylinder and the inner projections 559 are formed on the inner cylinder 504.

Another characteristic feature of the cartridge of the container for feeding a stick type cosmetic material of the present invention is the bending structure of the chuck.

That is, the attaching section of the chuck where the chuck stopper is attached, can bend inwardly to go through the chuck stopper when the chuck is inserted into the cylinder from the rear end in the process of assemblage of the cartridge, and then returns to its original shape and prevents the chuck from retracting.

Figure 11:
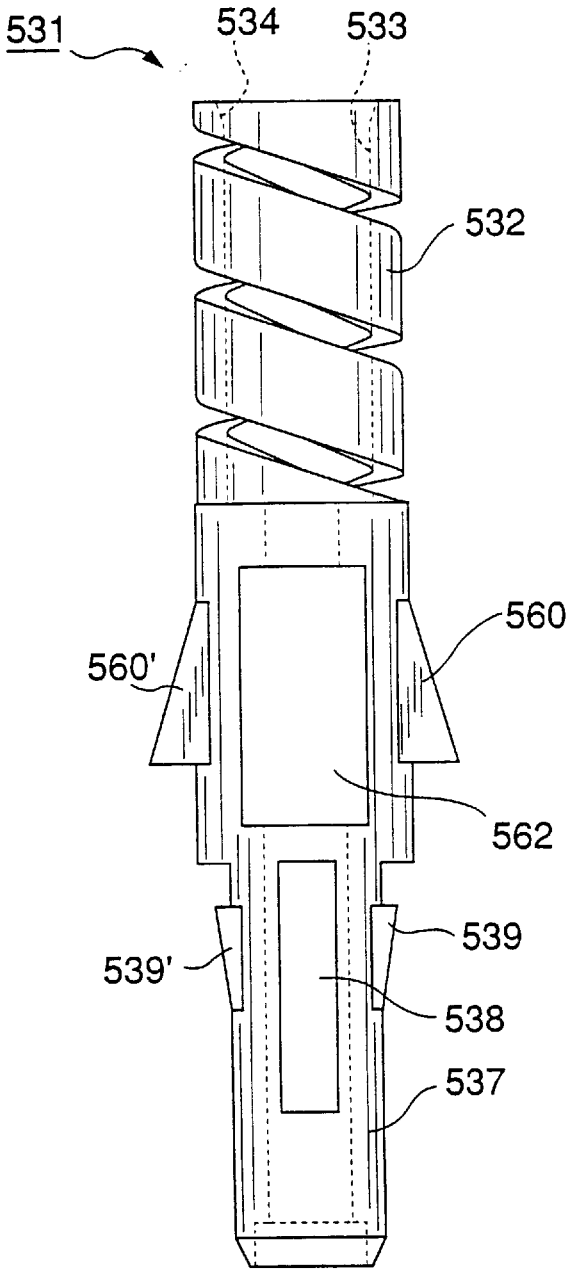
FIG. 11 shows a side view of the chuck used in the cartridge of FIG. 9.

FIG. 11 shows a side view of the chuck used in the cartridge of the container of FIG. 9 for feeding a stick type cosmetic material.

The chuck 531 in FIG. 11 has a coil-spring shaped holding portion 532, and the rear end of the stick type cosmetic material is inserted into the bore of the holding portion 532 to be held therein. The upper surface of the holding portion 532 is flat, and a tapered lead-in portion 534 is formed on the inner surface of the upper end of the holding portion 532, so the stick type cosmetic material can be inserted easily. The coil-spring shaped holding portion 532 elastically holds the stick type cosmetic material relative to the body of the chuck, and prevents damage to the cosmetic material.

The butts 560, 560' are so formed so as to protrude outwardly on the outer surface of the axially center portion of the chuck 531. The side sections of these butts 560, 560' are engaged with vertical grooves (vertical grooves 521 in FIG. 9) of the cartridge in which the chuck is inserted. The upper surface of the butts 560, 560' are slanted, and the lower surfaces are flatly perpendicular to the axial direction. As shown in FIG. 9, the lower surface of the butts 560, 560' abut against the upper surfaces of the respective inner projections 559 of the bore of the cartridge cylinder 502 to prevent the chuck from dropping off.

In FIG. 11, a bend window 562 which is opened widely between butts 560 and 560' of the chuck 531, is formed on the chuck 531. Therefore, if the chuck 531 gets such pressure that both butts 560 and 560' are pinched toward each other, both sides of the bend window 562 are bent inward and the butts 560 and 560' are drawn inward too. Because of this, the butts 560, 560' of the chuck 531 can pass through the inner projections 559, so when the chuck 531 is inserted into the cartridge cylinder 502 from the rear end, the chuck 531 is inserted easily. Moreover, after the chuck 531 is passed through, the butts 560, 560' will return (spring back by the resilience of the material) to their original shape, so the chuck cannot retract because the upper surface of the inner projections 559 meets the lower surface of the butts 560, 560'. Both surfaces contacting, to prevent the chuck 531 from retracting, are vertical against the retracting direction of the chuck, so the pressure of the contact of both surfaces will not affect the structure of the bend window 562. Therefore, the butts 560, 560' will not be drawn inwardly by them.

The spring retaining section 537 is formed on the outer surface of the rear or lower end of the chuck 531. The pull-spring (541 in FIG. 9) for automatic-returning of the chuck 531 is engaged with the spring retaining section 537. The wire of this pull-spring 541 is hooked to engage the spring retaining projections, which are formed on the spring retaining section 537. The window 538 is opened and penetrated through the chuck section 537 between the spring retaining projections 539, 539', and because of this window 538, the space between both retaining projections 539, 539' is reduced by pinching both projections 539, 539' to enable the wire of the pull-spring 531 to pass over the rear end of the chuck 531 easily. Then the rear end of the chuck 531 meets with the push rod (671 in FIG. 12) housed in the main body, and the chuck 531 and the stick type cosmetic material are advanced or retracted by the push rod.

The assembling method of the cartridge in FIG. 9 will now be described. First, the front portion of the wire of the pull-spring 541 is forced onto the spring retaining portion 537 of the chuck 531 to be engaged with the spring retaining projections 539, 539'. Because of this engagement, the chuck 531 and the pull-spring 541 are assembled.

Next, from the rear end of the bore of the inner cylinder 504, the assembly of the chuck 531 and the pull-spring 541 is inserted. At this time, the rear end of the chuck 531 is pushed by a thin stick. Under this circumstance, the upper surface of the butts 560, 560' of the chuck 531 meet with the lower surface of the inner projections 559. Both surfaces have a slanted surface that makes them easy to slide relative to each other, and the butts 560, 560' are drawn inward because of the bend window 562, the butts 560, 560' of the chuck 531 can pass between the inner projections 559 smoothly. Then, the lower surface of the butts 560, 560' meet with the upper surfaces of the respective inner projections 559. Therefore, the chuck 531 can not come out of the cylinder. At this point, the rear end 545 (wider diametered section) of the pull-spring 541 is attached to the spring retaining surface 519, and because of that, the spring 541 is stretched. Therefore, the chuck 531 is always in tension.

Next, the cartridge cylinder 502 is assembled by inserting the front end of the inner cylinder 504 into the outer cylinder 503. Both cylinders are retained axially and diametrically by the rolets 553 and the engagement ridge and recess, and then, the assembly of the cartridge is finished. Also, the chuck 531 can be inserted into the inner cylinder 504 after the cartridge is assembled. However, it is preferred (in terms of practical manufacturing) to keep assembled inner cylinders in stock as unit, and then assemble an outer cylinder according to a user's order on shape, color, decoration and printing.

FIG. 12 shows a cross-sectional view of the cartridge in FIG. 9 and the inner structure of the cartridge and a main body of the container to which the cartridge will be attached.

The main body 650 of the container for feeding a stick type cosmetic material comprises a body cylinder 651, internal threaded member 661, push rod 671, brush 678, cap 680, C-shaped ring 695, and spring 701. The body cylinder has a hollow-cylindrical shape, and a connectable section 653 is formed on the opening of the body cylinder. Near the upper end of the connectable section 653, an annular connectable recess 654 is also formed. The connectable projections 525, formed on the outer surface of the cartridge cylinder 502 described above, are snappingly engaged (due to the resilience of the materials used) with the annular connectable recess 654 to thereby connect the cartridge and the main body.

The body cylinder 651 has a simple cylindrical shape, with four vertical internal grooves 652, which are elongated linearly in four rows with an angle of 90° between the rows in the circumferential direction. The butts 677, formed on the outer surface of the flange 675 of the push rod 671, are engaged with the vertical grooves 652 so as to be axially slidable in the body cylinder 651, so the push rod 671 and the body cylinder 651 can synchronously rotate.

The brush holder 679 is mounted on the rear end of the body cylinder 651. The brush 678 is used by users for example to shade eyeliner or eye-color. The cap 680 is put on over the brush 678, and on the connectable section of the brush holder 678 and the body cylinder 651. An annular ridge 715 is formed on the brush holder 679 and an annular recess 714 is formed on the body cylinder 651 to connect them together.

The cylindrical internally threaded member 661 is provided inside the body cylinder 651, and two lines of the spiral grooves 663 are formed on the inner circumference of the bore of the internal thread 661. Instead of two lines, the spiral groove can have only one line, or more than two lines. The spiral grooves 663 are engaged with the group of projections 673 which are formed on the outer circumference of the push rod 671; that is, both the spiral grooves and the group of projections will operate as a combination of engaged internal-thread-and-external-thread devices. Also, four engageable ribs 665, which are elongated axially, are formed on the outer circumference of the internally threaded member 661. When the cartridge is attached to the main body of the container, these ribs 665 are engaged with the synchronously engageable axially directed grooves 523 which are formed on the inner surface of the lower portion of the cartridge cylinder 511 to cause cartridge cylinder 511 to synchronously rotate with the internally threaded member 661.

A coil spring 701 is arranged between the upper surface of the flange 675 of the push rod 671 and the lower surface of the annular recess member 713. Spring 701 surrounds the push rod 671, and urges the push rod 671 in a backward (downward) direction between both surfaces. Because of the spring 701, when the cartridge is pulled out of the main body, the internal thread 661 becomes free so that the push rod 671 will automatically return to the retracted position from the former position, without a rotational movement. Therefore, whenever the cartridge is replaced, the push rod 671 is always kept at the retracted position, and the stick type cosmetic material will never be fed out inadvertently when a new cartridge is attached. Thus, damage to the stick type cosmetic material can be prevented. Also, when the push rod 671 is automatically returned, the push rod 671 and the body cylinder are not relatively rotated, so the spring 701 will smoothly move without a twisting force.

The retracting extremity of the push rod 671 is determined by the lower surface of the C-shaped ring 695 and the upper surface of the internally threaded member 661 which are attached. The C-shaped ring is set on the annular groove, which is provided on the outer circumference of the push rod 671. It is fed out into the cartridge cylinder with the push rod, and the C-shaped ring 695 prevents the push rod 671 from retracting when its lower surface meets the upper surface of the internally threaded member 661.

The O-ring 526, which is arranged on the outer surface of the cartridge 501, gives regular rotational resistance to the cartridge cylinder 511 and the body cylinder 651. If there is no rotational resistance between them, the push rod 671, the internal thread 661, and the cartridge cylinder 511 will run idle and the push rod 671 will return to the retracted extremity by the force of the spring 701 and the pull-spring 541.

A flat portion 711, which has flat-circumference without the group of projections 673, is formed on the lower portion of the push rod 671 of the main body 650 of the container. The diameter of the flat portion 711 is the same as the diameter of the other portions of the push rod 671 with the projections 673. When the push rod 671 is at the advanced extremity, the flat portion 711 is located at a position where it will be engaged with the internally threaded member 661. Accordingly, in this condition, if the cartridge and the main body are relatively rotated, the internally threaded member 661 and the push rod 671 will run idle. Also the push rod 671 is forced to the backward (retracted) direction by the spring 701 and the pull-spring 541 of the cartridge. So, when they run idle, there is an interference and an audible noise, because the projections 673 of the push rod are coming into and going out of the spiral grooves 663. Therefore by this audible noise the user can notice that the stick type cosmetic material is at the most advanced extremity (i.e. it is at the advancing limit).

From the descriptions above, it is seen that the container for feeding a stick type cosmetic material of the present invention has the following effects:

(1) The container for feeding a stick type cosmetic material utilizes a coil-spring shaped holding portion for the stick type cosmetic material, thus holding the stick type cosmetic material elastically. Therefore, even if the container has pressure applied thereto, or if the container is dropped, the stick type cosmetic material can be prevented from being damaged.

(2) In the container for feeding a stick type cosmetic material according to one embodiment of the present invention, the chuck is engaged with a chuck stopper only by inserting the chuck from the rear end of the inner cylinder. Accordingly, it is easy to assemble the cartridge.

Various modifications and alterations can be made within the scope of the appended claims. Features of one embodiment can be combined with other embodiments, consistent with proper operation. While the principles of the invention have been described above in connection with specific apparatus, it is to be clearly understood that this description is made only by way of example and not as a limitation on the scope of the invention.

What is claimed is:

1. A container for feeding a stick type cosmetic material, comprising:

a front cylinder having a bore in which a stick type cosmetic material is to be mounted so as to be advanced or retracted relative to said front cylinder;

a main cylinder coupled to said front cylinder in an axial direction of said front cylinder so as to be rotatable relative to said front cylinder about an axis of said front cylinder;

a push rod mounted in said front and main cylinders and in said bore of said front cylinder, for feeding a stick type cosmetic material axially of said front and main cylinders in advancing and retracting directions; and a coil-spring shaped holding portion at a front end of said push rod for engaging and holding a rear end portion of a stick type cosmetic material.

2. The container of claim 1, wherein said push rod and said main cylinder are threadably coupled together such that rotating said main cylinder relative to said front cylinder and relative to said push rod causes said push rod to advance or retract.

3. The container of claim 2, wherein said push rod is slidably mounted in said front cylinder and means is provided for maintaining said push rod non-rotational relative to said front cylinder.

4. The container of claim 2, wherein said push rod includes inclined members on a circumferential portion thereof which define portions of threads thereon, and wherein said front cylinder has an elongated internal longitudinally slotted portion for receiving said inclined portions in a non-rotational manner, to thereby prevent said push rod from rotating relative to said front cylinder.

5. The container of claim 1, wherein said push rod has an enlarged member at an end thereof opposite said front end, and wherein said main cylinder has a slotted portion at a front end thereof which enables a front end portion of said main cylinder to spread outwardly to receive said enlarged member of said push rod therein.

6. The container of claim 5, wherein said front cylinder has a portion which surrounds said front end of said main cylinder to prevent said slotted portion of said main cylinder from spreading outwardly when said front cylinder is coupled to said main cylinder.

7. The container of claim 1, wherein said coil-spring shaped holding portion has internally directed ribs thereon for biting into at least a portion of a stick type cosmetic material to be engaged and held by said coil-spring shaped holding portion.

8. The container of claim 1, wherein said coil-spring shaped holding portion is arranged to hold a stick type cosmetic material elastically and movably relative to said push rod and relative to said front and main cylinders at least in the axial direction of said front and main cylinders.

9. The container of claim 8, wherein said push rod and said main cylinder are threadably coupled together such that rotating said main cylinder relative to said front cylinder and relative to said push rod causes said push rod to advance or retract.

10. The container of claim 9, wherein said push rod is slidably mounted in said front cylinder and means is provided for maintaining said push rod non-rotational relative to said front cylinder.

11. The container of claim 9, wherein said push rod includes inclined members on a circumferential portion thereof which define portions of threads thereon, and wherein said front cylinder has an elongated internal longitudinally slotted portion for receiving said inclined portions in a non-rotational manner, to thereby prevent said push rod from rotating relative to said front cylinder.

12. The container of claim 8, wherein said push rod has an enlarged member at an end thereof opposite said front end, and wherein said main cylinder has a slotted portion at a front end thereof which enables a front end portion of said main cylinder to spread outwardly to receive said enlarged member of said push rod therein.

13. The container of claim 12, wherein said front cylinder has a portion which surrounds said front end of said main cylinder to prevent said slotted portion of said main cylinder from spreading outwardly when said front cylinder is coupled to said main cylinder.

14. The container of claim 8, wherein said coil-spring shaped holding portion has internally directed ribs thereon for biting into at least a portion of a stick type cosmetic material to be engaged and held by said coil-spring shaped holding portion.

15. A container for feeding a stick type cosmetic material, comprising:

a main body having a push rod housed therein such that said push rod is movable relative to said main body in an axial direction of said push rod and said main body;

a cartridge, rotatably attached to a front end of said main body, which feeds a stick type cosmetic material in said axial direction;

said push rod being movable axially inside of said cartridge when said main body and said cartridge are relatively rotated; and said cartridge having a chuck which is engageable with said push rod, said chuck having a coil-spring shaped holding portion which is engageable with an end portion of a stick type cosmetic material for holding an engaged stick type cosmetic material.

16. The container of claim 15, wherein said push rod and said main cylinder are threadably coupled together such that rotating said main cylinder relative to said cartridge and relative to said push rod causes said push rod to advance or retract.

17. The container of claim 16, wherein said push rod is slidably received in said cartridge, and means is provided for maintaining said push rod non-rotational relative to said cartridge.

18. The container of claim 16, wherein said push rod includes inclined members on an outer circumferential portion thereof which define portions of threads thereon, and wherein said cartridge has an elongated internal slotted portion for receiving said inclined portions in a non-rotational manner, to thereby prevent said push rod from rotating relative to said cartridge.

19. The container of claim 15, wherein said coil-spring shaped holding portion has internally directed ribs thereon for biting into at least a portion of a stick type cosmetic material to be engaged and held by said coil-spring shaped holding portion.

20. The container of claim 15, wherein said coil-spring shaped holding portion is arranged to hold a stick type cosmetic material elastically and movably relative to said push rod and relative to said cartridge and main body at least in the axial direction of said cartridge and main body.

21. The container of claim 20, wherein said push rod and said main cylinder are threadably coupled together such that rotating said main cylinder relative to said cartridge and relative to said push rod causes said push rod to advance or retract.

22. The container of claim 21, wherein said push rod is slidably received in said cartridge, and means is provided for maintaining said push rod non-rotational relative to said cartridge.

23. The container of claim 21, wherein said push rod includes inclined members on an outer circumferential portion thereof which define portions of threads thereon, and wherein said cartridge has an elongated internal slotted portion for receiving said inclined portions in a non-rotational manner, to thereby prevent said push rod from rotating relative to said cartridge.

24. The container of claim 20, wherein said coil-spring shaped holding portion has internally directed ribs thereon for biting into at least a portion of a stick type cosmetic material to be engaged and held by said coil-spring shaped holding portion.

* * * * *

UNITED STATES PATENT AND TRADEMARK OFFICE

CERTIFICATE OF CORRECTION

PATENT NO. : 5,816,727

DATED : October 6, 1998

INVENTOR(S) : Ohba et al.

It is certified that error appears in the above-identified patent and that said Letters Patent is hereby corrected as shown below:

Column 1, line 1 and
On the Title page, under Item [54] Title, change "COSMETICS" to --COSMETIC--.

Signed and Sealed this

Twenty-first Day of September, 1999

*Attest:*

Q. TODD DICKINSON

*Attesting Officer*

*Acting Commissioner of Patents and Trademarks*

UNITED STATES PATENT AND TRADEMARK OFFICE

CERTIFICATE OF CORRECTION

PATENT NO. : 5,816,727

DATED : October 6, 1998

INVENTOR(S) : Ohba et al.

It is certified that error appears in the above-identified patent and that said Letters Patent is hereby corrected as shown below:

On the Title page:

Item [73] Assignee, change "Suzono" to --Suzuno--.

Signed and Sealed this

Twenty-ninth Day of August, 2000

*Attest:*

*Attesting Officer*

Q. TODD DICKINSON

*Director of Patents and Trademarks*